US008587199B2

(12) United States Patent
Hamazu et al.

(10) Patent No.: US 8,587,199 B2
(45) Date of Patent: Nov. 19, 2013

(54) DISCHARGE LAMP UNIT

(75) Inventors: Youichi Hamazu, Kariya (JP); Yoshihiro Wanda, Okazaki (JP)

(73) Assignee: Denso Corporation, Kariya (JP)

( * ) Notice: Subject to any disclaimer, the term of this patent is extended or adjusted under 35 U.S.C. 154(b) by 941 days.

(21) Appl. No.: 12/710,775

(22) Filed: Feb. 23, 2010

(65) Prior Publication Data

US 2010/0213844 A1 Aug. 26, 2010

(30) Foreign Application Priority Data

Feb. 26, 2009 (JP) ..... 2009-044133

(51) Int. Cl.
*H01J 1/02* (2006.01)

(52) U.S. Cl.
USPC ..... 315/51; 315/53; 362/240

(58) Field of Classification Search
USPC ..... 315/77–82, 51, 52; 362/240
See application file for complete search history.

(56) References Cited

U.S. PATENT DOCUMENTS

| | | | | |
|---|---|---|---|---|
| 5,690,419 | A * | 11/1997 | Siems | 362/269 |
| 6,710,545 | B2 | 3/2004 | Yamaguchi et al. | |
| 2003/0006706 | A1 * | 1/2003 | Yamaguchi et al. | 315/82 |
| 2005/0189554 | A1 * | 9/2005 | Dry | 257/96 |

FOREIGN PATENT DOCUMENTS

| | | |
|---|---|---|
| JP | 3-116510 | 12/1991 |
| JP | 03-116510 | * 12/1991 |
| JP | 2003-022702 | 1/2003 |

OTHER PUBLICATIONS

Japanese Office Action dated Jan. 11, 2011, issued in corresponding Japanese Application No. 2009-044133 with English Translation.

* cited by examiner

*Primary Examiner* — Douglas W Owens
*Assistant Examiner* — Jonathan Cooper
(74) *Attorney, Agent, or Firm* — Nixon & Vanderhye PC

(57) ABSTRACT

A discharge lamp unit has a supporting part for supporting a discharge lamp, and circuit elements from which electric power is supplied to the discharge lamp through electric wires. The electric wires have radiation parts. In order to increase an amount of heat energy radiated and discharged from the radiation parts, each of the radiation parts has a large surface area when compared with that of parts other than the radiation parts in the electric wires. The structure of the electric wires makes it possible to decrease heat energy conducted from the discharge lamp side toward the circuit elements.

8 Claims, 4 Drawing Sheets

DISCHARGE LAMP UNIT

CROSS-REFERENCE TO RELATED APPLICATION

This application is related to and claims priority from Japanese Patent Application No. 2009-044133 filed on Feb. 26, 2009, the contents of which are hereby incorporated by reference.

BACKGROUND OF THE INVENTION

1. Field of the Invention

The present invention relates to a discharge lamp unit capable of supporting a discharge lamp and preventing heat conduction between the discharge lamp and circuit elements forming a lighting unit placed in the inside of a housing case member of the discharge lamp unit, and in particular, the discharge lamp unit having electric wires composed of a base part and branch parts serving as radiation parts in order to efficiently radiate heat energy.

2. Description of the Related Art

There are various types of conventional discharge lamp units, each of which is comprised of, a housing case member, a supporting member capable of supporting a discharge lamp, and a lighting circuit composed of circuit elements to supply electric power to the discharge lamp, such as coils, capacitances, and integrated circuits mounted on a semiconductor substrate. (For example, Japanese patent laid open publication No. JP 2003-022702 discloses such a conventional discharge lamp.)

Because electric wires are made of metal of a high conductivity and connect the circuit elements forming the lighting circuit and the discharge lamp through the supporting member, the electric wires easily conduct heat energy generated in the discharge lamp to the circuit elements placed in the housing case member. This makes it possible to easily heat the circuit elements of the lighting circuit, and thereby to increase the temperature of the circuit elements. As a result, the temperature rise changes and deteriorates the characteristics of the circuit elements.

SUMMARY OF THE INVENTION

It is an object of the present invention to provide a discharge lamp unit composed mainly of a supporting member capable of supporting a discharge lamp, a heat discharging part, a housing case member, and a lighting circuit composed of circuit elements, and having an improved structure to suppress heat conduction between the discharge lamp and the circuit elements placed in the housing case member.

To achieve the above purposes, the present invention provides a discharge lamp unit comprised mainly of a supporting member capable of supporting a discharge lamp, a lighting circuit composed of circuit elements, and an electric wire. The lighting circuit composed of the circuit elements supplies electric power to the discharge lamp supported by the supporting member. The electric wire electrically connects the circuit elements and the discharge lamp through the supporting member. In the discharge lamp unit, the electric wire has a radiation part. In particular, a surface area of the radiation part in the electric wire is larger per unit length than parts other than the radiation part in the electric wire.

According to the discharge lamp unit having the above structure, because the surface area of the radiation part is larger per unit length than the part other than the radiation part in the electric wire, it is possible to easily conduct or radiate heat energy into materials (such as air and components) forming the discharge lamp unit. As a result, this can increase the amount of heat energy to be radiated through the radiation part of the electric wire, and also decreases the amount of heat energy which is supplied or conducted to the circuit elements in the lighting circuit. This makes it possible to prevent heat energy generated in the discharge lamp from being conducted to the circuit elements.

It is sufficient for the radiation part to have a higher heat conductivity than the materials placed around the electric wire. It is also sufficient that the electric wire in the discharge lamp unit electrically connects the discharge lamp and the circuit elements through the supporting member and heat resistance components having heat resistance function as other circuit components such as resistances. That is, it is possible to form the radiation part in the electric wire between the heat resistance components and the circuit elements.

In the discharge lamp unit as another aspect of the present invention, the entire of the electric wire having the radiation part is made of the same material (or an identical material).

Because the entire of the electric wire having the radiation part is made of the same material, it is possible to avoid any assembling step assembling the radiation part and the electric wire during a step of producing the discharge lamp unit. This structure makes it possible to easily produce the discharge lamp unit because of eliminating the step of assembling the electric wire and the radiation part together.

In the discharge lamp unit as another aspect of the present invention, the radiation part in the electric wire is composed of a base part and a plurality of branch parts, and the base part has a straight-line shape, and the branch parts are branched from the base part.

Because the discharge lamp unit having the above structure can efficiently increase the surface area of the radiation part having a plurality of the branch parts, it is possible to efficiently radiate and discharge heat energy from the branch parts of the radiation part to an air in a hollow part formed in the housing case member. Further, because the base part has a straight-line shape, it is possible to prevent extending of the entire length of the electric wire. That is, this structure of the electric wire having the radiation part composed of the branch parts prevents the electric resistance of the electric wire from increasing.

The discharge lamp unit as another aspect of the present invention further has a housing case member which accommodates the circuit elements and the supporting member so that a part of the supporting member is exposed to the outside of the discharge lamp unit. In the discharge lamp unit, at least a part of the radiation part contacts with the hollow part formed in the housing case member.

Because the heat energy in the radiation part is radiated into the air convecting within the hollow part, it is possible to improve the efficiency of radiating heat energy of the radiation part.

In the discharge lamp unit as another aspect of the present invention, the housing case member is made of metal.

Because the housing case member made of metal can shield the radiation part (in the electric wire, it is possible to prevent external noise generated outside of the discharge lamp unit as another aspect of the present invention from entering into the electric wire.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
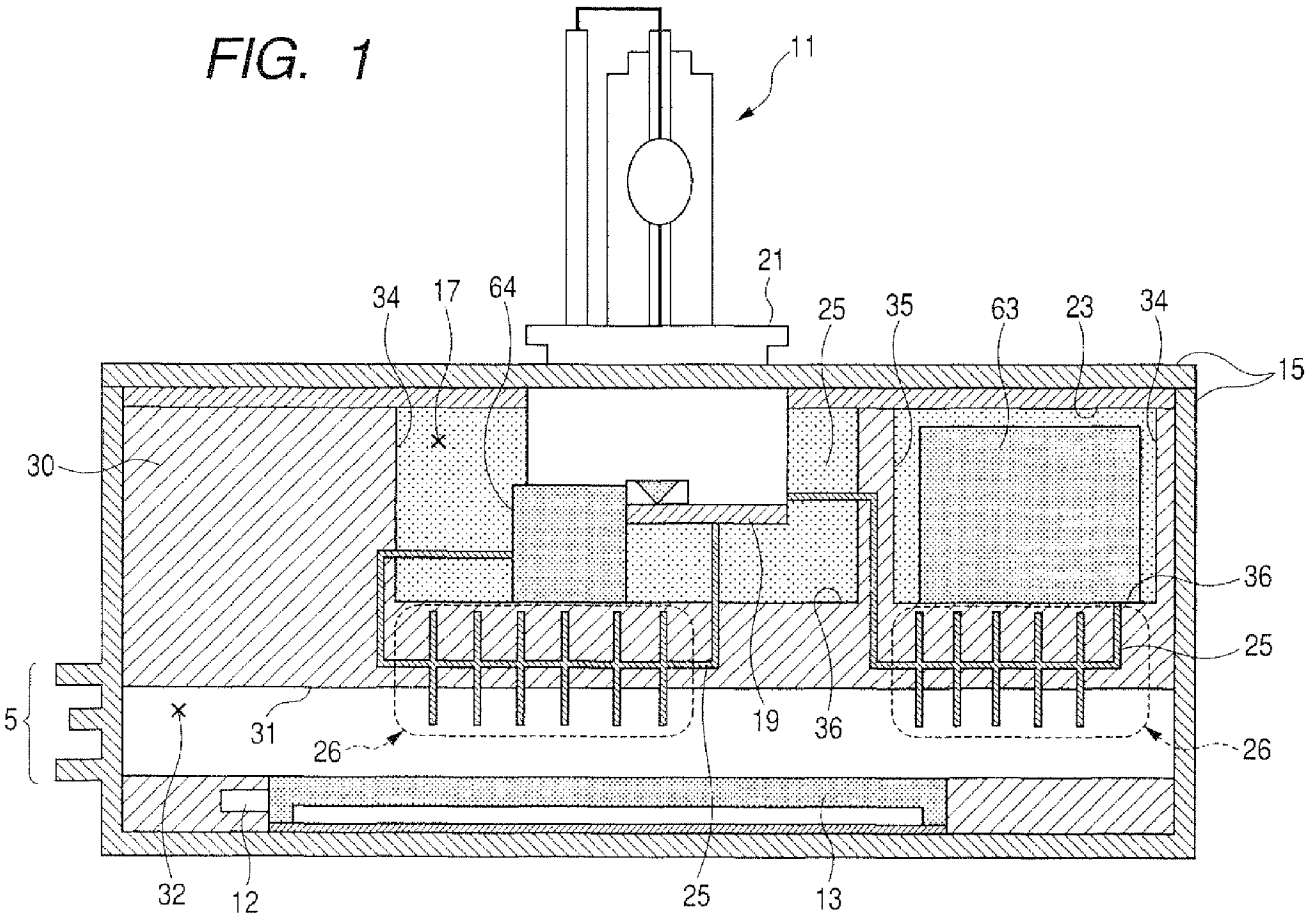
FIG. 1 is a cross section of a discharge lamp unit according to an embodiment of the present invention.

Hereinafter, various embodiments of the present invention will be described with reference to the accompanying drawings. In the following description of the various embodiments, like reference characters or numerals designate like or equivalent component parts throughout the several diagrams.

Embodiment

A description will be given of the discharge lamp unit according to an embodiment of the present invention with reference to FIG. 1 to FIGS. 4A to 4D.

FIG. 1 is a cross section of the discharge lamp unit 1 according to the embodiment of the present invention. That is, FIG. 1 shows the cross section along A-A line shown in FIG. 3.

The discharge lamp unit 1 is comprised mainly of a housing case member 15, a lighting circuit, and a discharge lamp supporting part 21 (or a supporting member) for supporting a discharge lamp 11.

The housing case member 15 accommodates the lighting circuit having circuit elements to light up the discharge lamp.

In more detail, the housing case member 15 is made of metal such as aluminum or stainless steel, and accommodates the circuit substrate 13 which mounts the circuit elements such as integrated circuit chips (or IC chips), coils, capacitances, and electric wires 12 (25). Through the electric wires 12 (25) the circuit elements are electrically connected.

The housing case member 15 supports the discharge lamp supporting part 21 so that the discharge lamp supporting part 21 is exposed to the outside of the discharge lamp unit 1. A reflection member (omitted from drawings) having a reflection surface of a concave shape can be placed between the housing case member 15 and the discharge lamp supporting part 21. The reflection member reflects the light emitted from the discharge lamp 11 toward a front of the discharge lamp unit 1, that is, a front of a vehicle.

The inside space of the housing case member 15 is divided into a plurality of spaces or chambers (which serve as component mounting parts) by mold resin 30 which is injected during a manufacturing process of the discharge lamp unit 1. That is, the separation wall 31 made of mold resin divides the inside space of the housing case member 15 into a first floor part and a second floor part, for example, between the discharge lamp supporting part 21 and the circuit substrate 13.

The separation wall 31 is placed perpendicular to the optical axis of the light emitted from the discharge lamp 11.

The circuit substrate 13 is placed in the first floor part (at the bottom side in the inside space of the housing case member 15 observed from the separation wall 31) divided by the separation wall 31.

On the other hand, the discharge lamp supporting part 21 is placed in the second floor part (at the upper side in the inside space of the housing case member 15 observed from the separation wall 31).

Further, a hollow part 32 is formed between the separation wall 31 and the circuit substrate 13 in the first floor part. No component is placed in the hollow part 32.

The hollow part 32 communicates with the outside of the discharge lamp unit 1 through openings (omitted from drawings). In the second floor part of the housing case member 15, side walls 34 and separation walls 35 made of mold resin 30 form a plurality of chambers as component mounting parts. Each of the chambers (serving as the component mounting parts) has a cup shape in which a circuit element is placed. As shown in FIG. 1, the embodiment shows two chambers formed in the second floor part of the housing case member 15. The side walls 34 and separation walls 35 are formed in parallel to the optical axis of the light emitted from the discharge lamp 11.

That is, the chambers have a cup shape which serve as the component mounting parts 36, and in each of which the circuit component is placed. Through the specification of the present invention, the "cup shape" indicates a structure composed of a bottom part and side wall parts. This bottom part is a part of the surface of the separation wall at the discharge lamp supporting unit 21 side. These side wall parts 34 serve as the side walls and the partition walls. Each of the side wall parts 34 has an open part which is opposite to the bottom part. That is, the cup shape has a structure to prevent leakage of liquid filling material from each of the component mounting parts when each of the component mounting parts is filled with the liquid filling material.

After a circuit element is placed in each of the component mounting parts 36, the component mounting part 36 is filled with a liquid filling material 17 such as potting resin. The filling member 17 is then hardened.

The discharge lamp supporting part 21 and a resin cover part 23 which cover at least a part of the component mounting part 36 are assembled together. The discharge lamp supporting part 21 is positioned and separated from the separation wall 31 at a predetermined distance without directly contacting with the separation wall 31 because the resin cover part 23 is mounted on the side walls 34 and the separation walls 35.

In the structure of the discharge lamp unit 1 according to the embodiment of the invention shown in FIG. 1, a thermal insulation member 19 having a low heat conductivity rather than metal and resin is placed at the surface of the discharge lamp supporting part 21 at the separation wall 31 side (at the bottom side shown in FIG. 1). The space between the thermal insulation member 19 and the separating wall 31 is filled with the filling material 17. In other words, the thermal insulation member 19 is separated from the separation wall 31 by the filling member 17.

A starter transformer 63 and a noise reduction coil 64 as a part of the circuit elements in the lighting circuit 3 are electrically connected to the discharge lamp 11 supported by the discharge lamp supporting member 21 through the electric wires 25. The electric wires 25 are made of metal (such as copper or aluminum) having a higher heat conductivity than that of ambient materials such as resin and air. The electric wires 25 electrically connect the discharge lamp 11 and the circuit elements (for example, the starter transformer 63 and the noise reduction coil 64) in the lighting circuit 3 through the discharge lamp supporting member 21 and heat radiation parts 26.

The heat radiation parts 26 and the electric wires 25 are assembled together. For example, the heat radiation parts 26 and the electric wires 25 are made of the same material such as copper or aluminum.

Figure 4A:
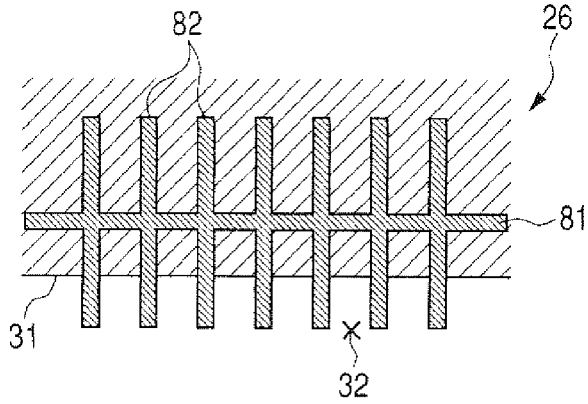
FIGS. 4A to 4D show various shapes of a radiation part of the discharge lamp unit according to the embodiment of the present invention.

The heat radiation parts 26 have a large surface area when compared with that of parts other than the heat radiation parts 26 in the electric wires 25. Specifically, each of the heat radiation parts 26 is composed of a base part 81 and a plurality of branches 82 of a straight-line shape. Those branches 82 extend from the base part 81 (as shown in FIG. 4A).

The heat radiation part 26 is placed in the housing case member 15 opposite to the discharge lamp supporting member 21 side. That is, the heat radiation part 26 is placed at the bottom side observed from the starter transformer 63 and the noise reduction coil 64. In the structure of the discharge lamp unit 1 according to the embodiment of the present invention, the heat radiation part 26 is placed in a lower temperature side which is separated far from the discharge lamp 11 (as a heat source) in order to increase the radiation and discharging amount of heat energy from the heat radiation part 26.

A part of each of the heat radiation parts 26 projects into the inside are of the hollow part 32, and the most part of the heat radiation part 26 is placed in the inside of the separation wall 31 (made of mold resin 30). The discharge lamp 11 in the discharge lamp unit 1 having the above structure lights up when receiving electric power supplied from an electric power source 6 (see FIG. 2) through the connector 5 in which conductive electric wires are placed. The connector 5 is placed at the side wall of the housing case member 15 and projects toward the outside of the housing case member 15.

Next, a description will be given of the circuit configuration of the lighting circuit 3 in the discharge lamp unit 1 according to the embodiment of the present invention with reference to FIG. 2.

Figure 2:
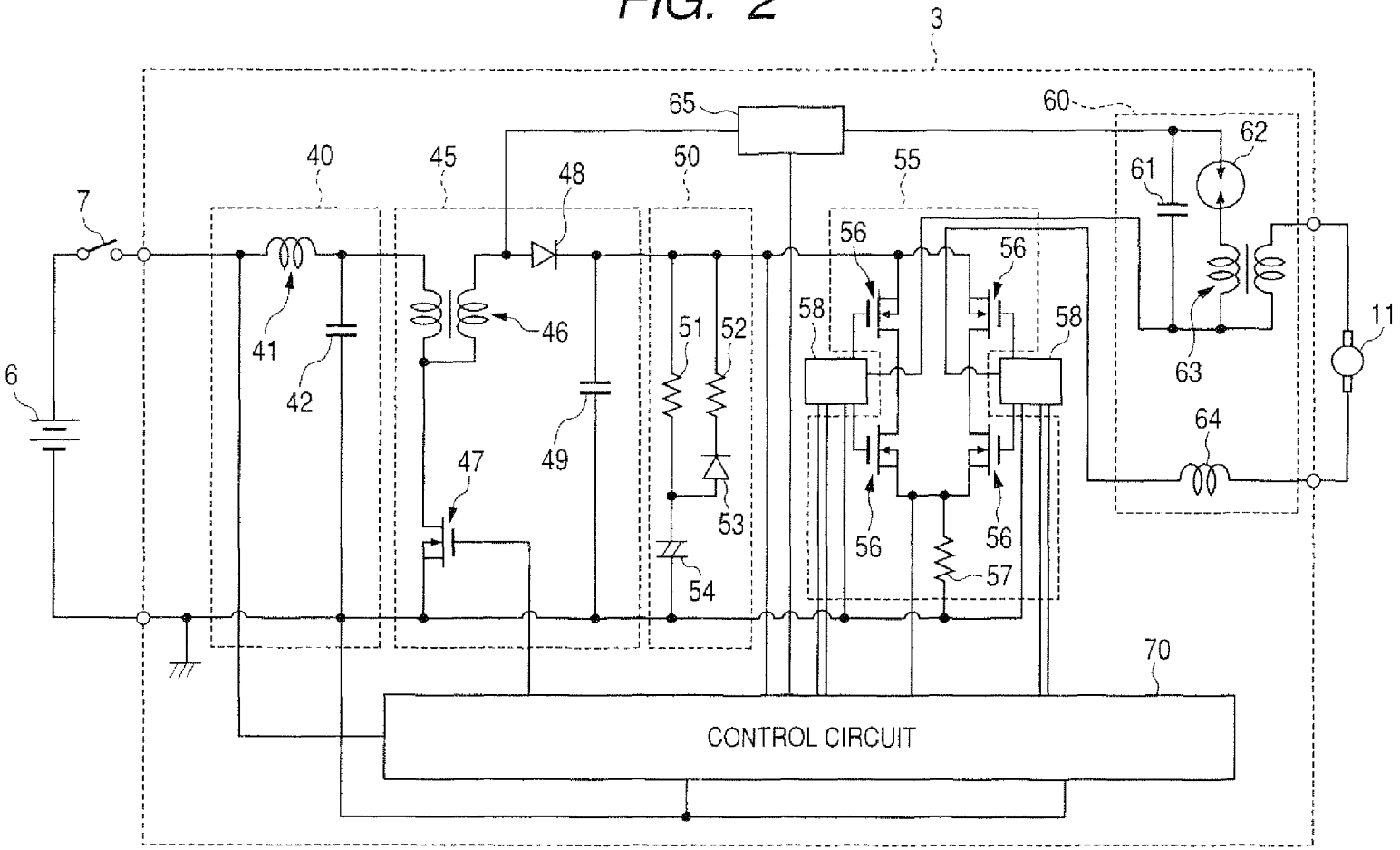
FIG. 2 is a view showing a configuration of a lighting circuit composed of circuit elements in the discharge lamp unit shown in FIG. 1.

FIG. 2 is a view showing a circuit configuration of the lighting circuit 3 to light up the discharge lamp 11 in the discharge lamp unit 1 shown in FIG. 1. As shown in FIG. 2, a battery 6 and a switch 7 are mounted in a vehicle. The battery 6 and the switch 7 are placed outside of the discharge lamp unit 1. When a driver of a vehicle turns on the switch 7, electric power is supplied from the battery 6 to the discharge lamp unit 1.

As shown in FIG. 2, the lighting circuit 3 in the discharge lamp unit 1 of the embodiment has a filter circuit 40, a DC/DC converter circuit 45, a light supplementary circuit 50, a H bridge circuit 55, a high voltage generation circuit 60, and a control circuit 70.

The filter circuit 40 has an input coil 41 and an input capacitor 42. The filter circuit 40 serves as a smoothing circuit to smooth a voltage of a power source of the battery 6.

The DC/DC converter circuit 45 has a DC/DC transformer 46, a power MOS transistor 47 as a power element, a diode 48, and a capacitor 49.

The DC/DC converter circuit 45 serves as a converter circuit to boost the voltage of the power source (for example, 12 volts) to an intermediate voltage (for example, 400 volts) which is supplied to the discharge lamp unit 1.

The light supplementary circuit 50 has two resistances 51 and 52, a diode 53, and an overtaking capacitance 54. The resistances 51 and 52 are connected in parallel to terminals of the power source. The diode 53 is connected in series to the resistance 52. The overtaking capacitance 54 is connected to the resistance 51 and the diode 53.

The light supplementary circuit 50 is a circuit to temporarily supply electric power to the discharge lamp 11, which is temporarily required when the discharge lamp 11 starts to light up. The overtaking capacitance 54 accumulates the electric power required when the discharge lamp 11 lights up.

The H bridge circuit 55 has four power transistors 56 and a resistance 57 which serves as a resistance to detect a current.

The H bridge circuit 55 is controlled by a driver 58 to switch those power transistors 56 when receiving an operation control signal transferred from a control circuit 70.

The output of the H bridge circuit 55 is converted from a direct current to an alternating current (that is, a square current) by the driver 58.

As shown in FIG. 2, the high voltage generation circuit 60 has a high voltage generating capacitance 61, a spark gap 62, a starter transformer 63, and a noise reduction coil 64.

The high voltage generating capacitance 61 charges a current to be supplied to a primary coil of the starter transformer 63. The spark gap 62 switches the discharging of the high voltage generating capacitance 61.

The starter transformer 63 provides a starter voltage (for example, 25 kV) to start the lighting of the discharge lamp 11. A booster circuit 65 supplies a high voltage when receiving an operation control signal transferred from the control circuit 70. When the voltage of the spark gap 62 reaches a predetermined voltage, the spark gap 62 allows current to flow. The control circuit 70 has a semiconductor element to control circuit elements in the lighting circuit 3.

The control circuit 70, the H bridge circuit 55, and the driver 58 in the lighting circuit 3 are mounted on the circuit substrate 13. It is possible for the booster circuit 65 to use a known booster circuit such as a charge pump circuit.

Next, a description will now be given of an actual arrangement of the circuit elements which form the lighting circuit 3 with reference to FIG. 3.

Figure 3:
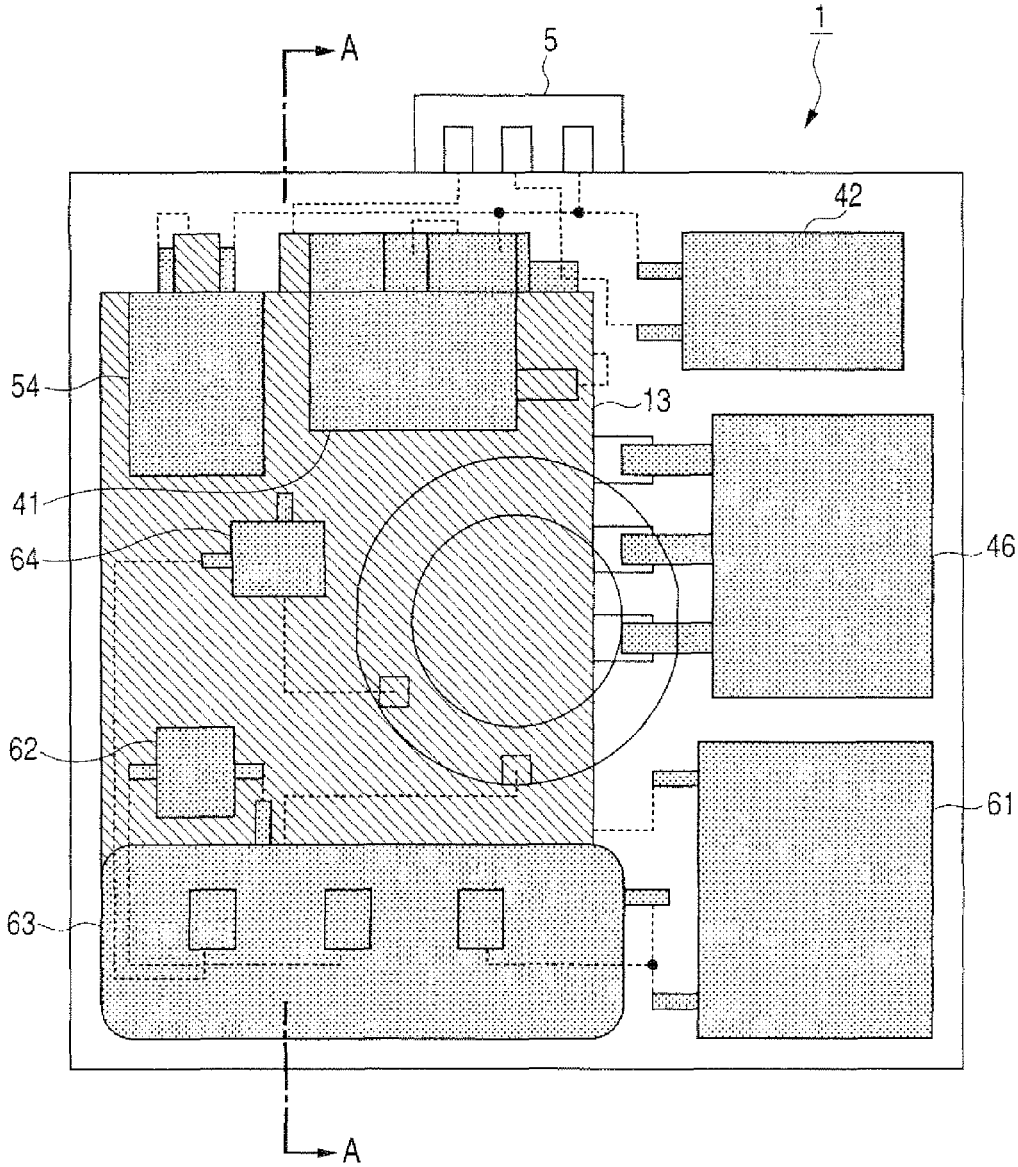
FIG. 3 is a view showing a housing case member observed from the discharge lamp side.

FIG. 3 is a view showing the housing case member 15 observed from the discharge lamp 11 side.

The arrangement of the circuit elements, which form the lighting circuit 3, is designed to decrease the size of the housing case member 15 as small as possible. That is, in the circuit configuration shown in FIG. 2, the circuit elements near to the battery 6 (as the circuit elements near to the left side in FIG. 2) are placed near to the connector 5 (at the upper side shown in FIG. 3A). The circuit elements of the lighting circuit 3 near to the discharge lamp 11 side (as the circuit elements near to the right side in FIG. 2) are separated from the connector 5 (at the bottom side shown in FIG. 3A) as far as possible.

Specifically, in the circuit configuration of the lighting circuit 3 in the discharge lamp unit 1 according to the embodiment, the input coil 41 and the input capacitance 42 which form the filter circuit 40 are arranged near to the connector 5. The overtaking capacitance 54, one terminal of which is grounded, is arranged in parallel to the input coil 41 near to the connector 5. The overtaking capacitance 54 is placed in parallel to the input coil 41 near to the connector 5. This arrangement prevents noise input through the connector 5 from being propagated toward a deep part in the housing case member 15 because the filter circuit 40 is placed near to the connector 5 capable of eliminating noise.

The high voltage generating capacitance 61 and the starter transformer 63, which form the high voltage generation circuit 60, are placed in parallel at the position which is most separated from the connector 5.

The spark gap 62 and the noise reduction coil 64, which form the high voltage generation circuit 60, are placed near to the starter transformer 63 and at the upper side of the circuit substrate 13.

In addition, because the most circuit elements of the high voltage generation circuit 60 are placed in the second floor part near to the discharge lamp supporting part 21, it is possible to decrease the length of the wire to connect the high voltage generation circuit 60 and the discharge lamp through the discharge lamp supporting part 21. This can prevent noise generated in the high voltage generation circuit 60 from being input into the other circuit elements.

As described above in detail, the discharge lamp unit 1 of the embodiment has the discharge lamp supporting part 21 for supporting the discharge lamp 11 and the circuit elements (such as the starter transformer 63 and the noise reduction coil 64) to supply electric power to the discharge lamp 11 supported by the discharge lamp supporting part 21.

The discharge lamp unit 1 further has the electric wires 25, which connect the discharge lamp and the circuit elements, having the heat radiation parts 26. Each of the heat radiation parts 26 has a larger surface area per unit length than that of parts other than the heat radiation parts 26 in the electric wires 25.

According to the discharge lamp unit 1 having the above structure, because the surface area of each of the heat radiation parts 26 is larger in unit length than that of parts other than the heat radiation parts 26 in the electric wires 25, it is possible to easily conduct heat energy in the heat radiation parts 26 to the components (such as the components forming the discharge lamp unit 1 and the ambient air). As a result, this structure makes it possible to increase the heat energy to be discharged to the outside of the discharge lamp unit 1 through the electric wires 25, and thereby to decrease the heat energy to be conducted to the circuit elements forming the lighting circuit 3. This makes it possible to prevent the heat energy generated in the discharge lamp 11 from being conducted to the circuit elements.

Further, because the heat radiation parts 26 and the electric wires 25 are made of the same material and integrated together, it is possible to form them by pressing a plate-shaped material. This can avoid any assembling step to assemble the heat radiation parts 26 to the electric wires 25 together during the production of the discharge lamp unit 1. This makes it possible to easily produce the discharge lamp unit 1.

Still further, the discharge lamp unit 1 has the housing case member 15 which accommodates the circuit elements forming the lighting circuit 3 so that a part of the discharge lamp supporting part 21 is exposed to the outside of the discharge lamp unit 1. It is acceptable for a part of the heat radiation parts 26 to conduct with the hollow part 32 which is formed in the inside space of the housing case member 15.

In the discharge lamp unit 1 having the above structure, because the heat energy in the heat radiation parts 26 can be radiated and discharged to the air which flows in convection in the hollow part 32, it is possible to improve the efficiency to radiate and discharge the heat energy through the heat radiation parts 26.

Further, because the housing case member 15 of the discharge lamp unit 1 is made of metal, this makes it possible to shield the heat radiation parts 26 (or the electric wires 25). This prevents noise from outside of the discharge lamp unit 1 from entering into the electric wires 25.

Still further, the heat radiation parts 26 in the discharge lamp unit 1 is composed of the base part 81 and the branch parts 82. In other words, the heat radiation parts 26 has a branch structure in which a plurality of the straight-line shaped branch parts 82 is branched from the base part 81.

According to the structure of the discharge lamp unit 1 described above, because the branch structure efficiently increases the entire surface area of the heat radiation parts 26, it is possible to radiate and discharge the heat energy through a plurality of the straight-line shaped branch parts 82. In addition, because the base part 81 has a straight-line shape in the discharge lamp unit 1 according to the embodiment, the electric wires 25 has a sufficient length, does not have any longer length in the heat radiation parts 26. That is, this structure of the straight-line shaped branch parts 82 prevents increasing of the electric resistance of the electric wires 25.

Another Modifications

The concept of the present invention is not limited by the structure of the discharge lamp unit 1 previously described. For example, it is possible for the discharge lamp unit 1 of the present invention to have various modifications.

FIGS. 4A to 4D show various shapes of the heat discharging parts of the discharge lamp unit 1 according to the embodiment of the present invention.

The first embodiment of the discharge lamp unit 1 has the shape of the heat radiation parts 26 shown in FIG. 4A.

Figure 4B:
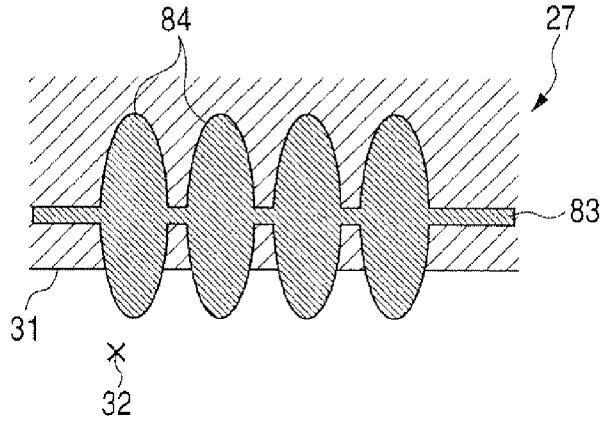
Figure 4C:
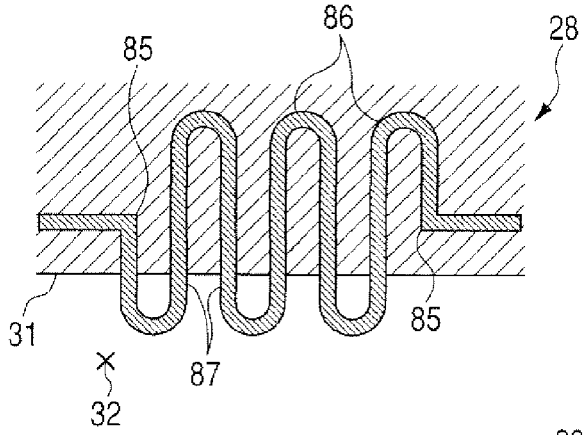
Figure 4D:
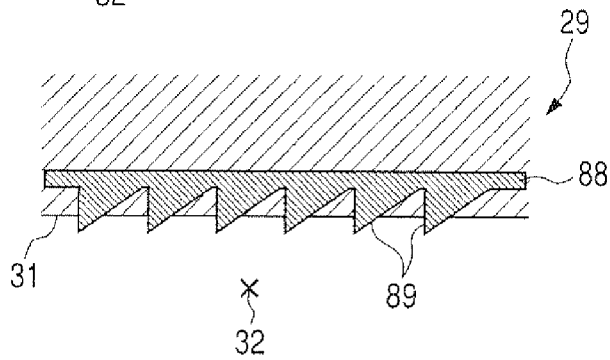

For example, it is possible for the heat radiation parts 26 to have each of shapes shown in FIG. 4B, FIG. 4C, and FIG. 4D unless the surface area of the heat radiation parts 26 is larger per unit length than that of parts other than the heat radiation parts 26 in the electric wires 25.

That is, as shown in FIG. 4B, it is possible for the discharge lamp unit 1 to have heat discharging parts 27, each of which is composed mainly of a plurality of branch parts 84 and a base part 83 of a straight-line shape, in which each of the branch parts 84 has an ellipse shape, and the branch parts 84 are branched from the base part 83 of a straight-line shape.

Still further, as shown in FIG. 4C, it is possible for the discharge lamp unit 1 to have heat discharging parts 28, each of which is composed of curved parts 85 and a plurality of straight-line shaped parts 87. In the discharge lamp unit 1, each of the curved parts 85 is obtained by bending the electric wire 25 at a right angle, and each of the straight-line shaped parts 87 is obtained by smoothly bending the electric wire 25 at 180°. Thus, it is possible to easily make each of the heat discharging parts 28 by using a single straight-line shaped electric wire.

Still further, as shown in FIG. 4D, it is possible for the discharge lamp unit 1 to have heat radiation parts 29, each of which is composed of a base part 88 of a straight-line shape and a plurality of blade parts 89 as branch parts, where each of the blade parts 89 as the branch parts projects from the base part 88 toward the hollow part 32 side. Those blade parts 89 are arranged like a saw-tooth shape.

According to the discharge lamp unit 1 having the heat radiation parts 29 having the structure shown in FIG. 4D, it is possible to decrease the total amount of a plate shaped member used when the heat radiation parts 29 are formed when compared with that when the heat radiation parts 26, 27 and 28 shown in FIGS. 4A, 4B, and 4C are formed.

It is also possible to have a structure in which each of the radiation parts 26, 27, 28, and 29 does not contact with or project into the inside space of the hollow part 32. Further, it is possible to have a structure for a part or the entire of the housing case member 15 to be made of material such as resin other than metal. Still further, it is possible to have a structure for at least a part of each of the radiation parts 26, 27, 28, and 29 to be made of material other than the material forming the electric wires 25.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A discharge lamp unit comprising:

a supporting member which supports a discharge lamp;

circuit elements which supply electric power to the discharge lamp supported by the supporting member; and an electric wire which electrically connects the circuit elements and the discharge lamp through the supporting member, a housing case member accommodating the circuit elements and the supporting member so that a part of the supporting member is exposed to the outside of the discharge lamp unit;

a circuit substrate placed at a bottom side of the housing case member; and a separation wall for dividing an inside space of the housing case member; wherein:

the electric wire has a radiation part, and a surface area of the radiation part is larger per unit length than a part other than the radiation part in the electric wire;

at least a part of the radiation part contacts with a hollow part formed in the housing case member;

a part of the circuit elements is mounted on the circuit substrate, and the separation wall is formed between the supporting member and the circuit substrate so that the supporting member is separated from the circuit substrate, and the hollow part is formed between the separation wall and the circuit substrate; and the radiation part is formed in the separation wall so that a part of the radiation part is exposed to an inside space of the hollow part.

2. The discharge lamp unit according to claim 1, wherein the entire of the electric wire having the radiation part is made of an identical material.

3. The discharge lamp unit according to claim 1, wherein the radiation part in the electric wire is composed of a base part and a plurality of branch parts, and the base part has a straight-line shape, and the branch parts are branched from the base part.

4. The discharge lamp unit according to claim 1 wherein the housing case member is made of metal.

5. The discharge lamp unit according to claim 1, wherein the base part of the radiation part is a straight-line shape, and each of the branch parts projected from the base part is a straight-line shape, and a part of the branch parts is exposed to the inside space of the hollow part.

6. The discharge lamp unit according to claim 1, wherein the base part of the radiation part is a straight-line shape, and each of the branch parts projected from the base part is an ellipse shape, and a part of the branch parts is exposed to the inside space of the hollow part.

7. The discharge lamp unit according to claim 1, wherein the radiation part is composed of curved parts and a plurality of straight-line shaped parts, in which each of the curved parts is obtained by bending the electric wire at a right angle, and each of the straight-line shaped parts is obtained by smoothly bending the electric wire at 180°.

8. The discharge lamp unit according to claim 1, wherein the base part of the radiation part is a straight-line shape, and the branch parts are projected from the base part and composed of blade parts of a saw tooth shape, and a part of the blade parts is exposed to the inside space of the hollow part.

* * * * *